US008227990B2

(12) United States Patent
Buttstaedt et al.

(10) Patent No.: US 8,227,990 B2
(45) Date of Patent: Jul. 24, 2012

(54) HIGH PRESSURE DISCHARGE LAMP WITH A CAPACITIVE STARTING AID

(75) Inventors: Johannes Buttstaedt, Falkensee (DE); Stefan Dunkel, Berlin (DE); Leon Grabinski, Berlin (DE); Janbernd Hentschel, Eichstaett (DE); Martin Tueshaus, Berlin (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 12/881,191

(22) Filed: Sep. 14, 2010

(65) Prior Publication Data

US 2011/0074285 A1 Mar. 31, 2011

(30) Foreign Application Priority Data

Sep. 30, 2009 (DE) ..... 10 2009 047 861

(51) Int. Cl.
*H01J 17/18* (2006.01)

(52) U.S. Cl. ..... 313/623; 313/624

(58) Field of Classification Search ..... 313/594, 313/623, 624
See application file for complete search history.

(56) References Cited

U.S. PATENT DOCUMENTS

| | | | |
|---|---|---|---|
| 4,010,397 | A | 3/1977 | Hon |
| 6,054,810 | A | 4/2000 | Yamamoto et al. |
| 6,198,223 | B1 | 3/2001 | Scholz |
| 6,268,698 | B1 | 7/2001 | Scholz |
| 6,631,255 | B1 | 10/2003 | Claxton et al. |
| 6,919,686 | B2 | 7/2005 | Okamoto et al. |
| 2003/0062831 | A1 | 4/2003 | Alderman et al. |
| 2003/0127985 | A1 | 7/2003 | Okamoto et al. |
| 2004/0119412 | A1 | 6/2004 | Katou et al. |
| 2005/0140295 | A1 | 6/2005 | Van Den Nieuwenhuizen |
| 2006/0108927 | A1 | 5/2006 | Gunther et al. |
| 2008/0303402 | A1 * | 12/2008 | Li et al. ..... 313/250 |
| 2009/0009084 | A1 * | 1/2009 | Bonigk et al. ..... 313/633 |
| 2009/0289554 | A1 | 11/2009 | Morkel |

FOREIGN PATENT DOCUMENTS

| | | | |
|---|---|---|---|
| DE | 2646577 | A1 | 5/1977 |
| DE | 102004056004 | A1 | 5/2006 |
| DE | 102005003129 | A1 | 7/2006 |
| DE | 102006033871 | A1 | 1/2008 |
| EP | 0922296 | B1 | 3/2002 |
| EP | 1398824 | B1 | 1/2009 |
| EP | 0967631 | B1 | 7/2010 |
| EP | 1901334 | B1 | 7/2010 |
| JP | 2004193061 | A | 7/2004 |
| WO | 9848447 | A1 | 10/1998 |
| WO | 2004057644 | A1 | 7/2004 |
| WO | 2006076879 | A1 | 7/2006 |
| WO | 2008154102 | A2 | 12/2008 |

OTHER PUBLICATIONS

English language abstract of JP 2004 193061 A.

* cited by examiner

*Primary Examiner* — Vip Patel

(57) ABSTRACT

A high pressure discharge lamp with a capacitive starting aid is provided. The high pressure discharge lamp may include an outer bulb; a discharge vessel that is accommodated in the outer bulb, the discharge vessel comprising at least one end with a seal in which an electrode system is fastened; a frame holding the discharge vessel in the outer bulb; and a starting aid fastened on the seal. The starting aid may have two functional parts.

7 Claims, 8 Drawing Sheets

HIGH PRESSURE DISCHARGE LAMP WITH A CAPACITIVE STARTING AID

CROSS-REFERENCE TO RELATED APPLICATION

This application claims priority to German Patent Application Serial No. 10 2009 047 861.2, which was filed Sep. 30, 2009, and is incorporated herein by reference in its entirety.

TECHNICAL FIELD

Various embodiments generally relate to a high pressure discharge lamp. Such lamps are, by way of example, high pressure discharge lamps for normal lighting or for photooptical purposes.

BACKGROUND

U.S. Pat. Nos. 6,198,223 and 6,268,698 disclose a high pressure discharge lamp with a discharge vessel in the case of which a starting aid is designed as a winding around one end of the discharge vessel.

SUMMARY

A high pressure discharge lamp with a capacitive starting aid is provided. The high pressure discharge lamp may include an outer bulb; a discharge vessel that is accommodated in the outer bulb, the discharge vessel comprising at least one end with a seal in which an electrode system is fastened; a frame holding the discharge vessel in the outer bulb; and a starting aid fastened on the seal. The starting aid may have two functional parts.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
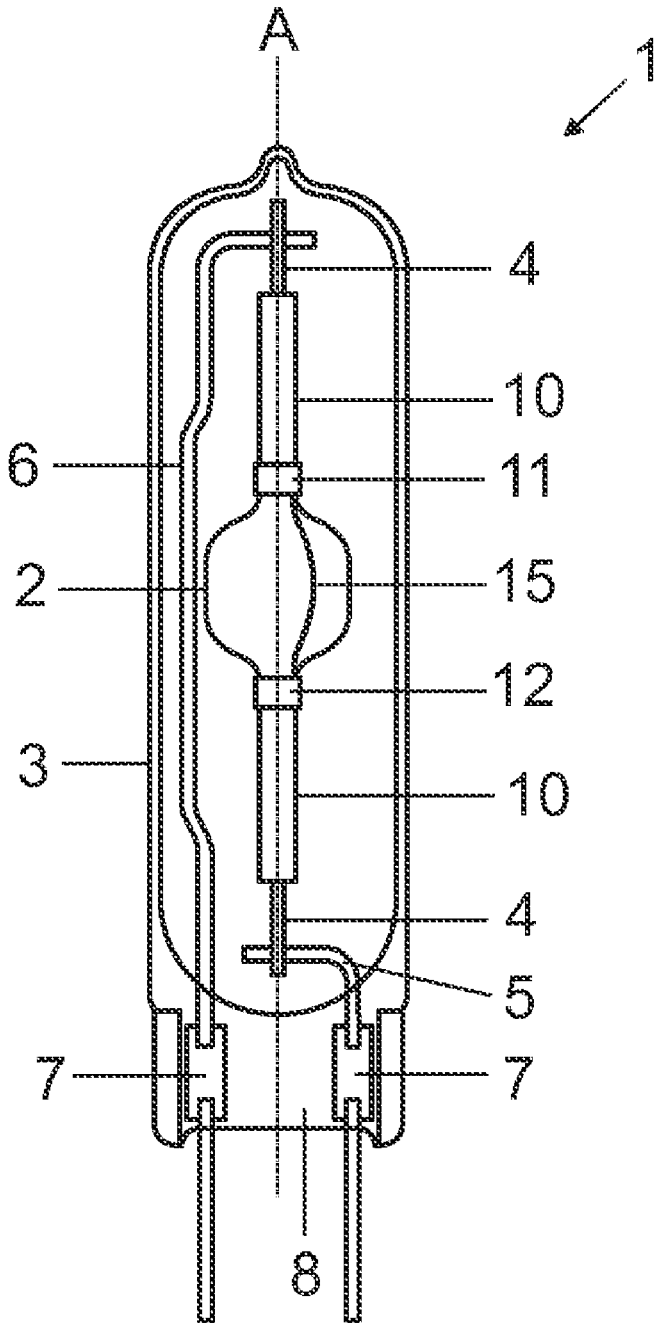
FIG. 1 shows a high pressure discharge lamp with a starting aid, in accordance with a first embodiment.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a high pressure discharge lamp whose starting is ensured with the aid of simple cost-effective means.

This applies, by way of example, to metal halide lamps, it being possible for the material of the discharge vessel to be ceramic or silica glass.

Various embodiments provide high pressure discharge lamps with a discharge vessel made from silica glass or ceramic, with or without an outer bulb. Chiefly concerned are discharge lamps for normal lighting, which as a rule have an evacuated or gas-filled outer bulb and are designed for service lives of 6000 hours or more.

Such high pressure discharge lamps are started with the aid of special starting devices. The starting characteristics of these starting devices are stipulated by appropriate standards. The conditions in the discharge vessel (volume, electrode spacing, fill gas, fill pressure, Hg amount, amount and type of metal halides) should be tuned to one another such that the lamp starts reliably given the stipulated starting conditions.

The application for various embodiments describes a solution that ensures reliable starting for high pressure discharge lamps.

With an increasing service life, there is a rise in the requisite voltage for starting high pressure discharge lamps. The effect of this can be that old lamps are no longer started by conventional starting devices. Rather, the ability to be started should be ensured over the entire service life, this being achieved by the arrangement in accordance with various embodiments, without the occurrence of appreciable additional costs.

To date, there have been various approaches to solving this.

a) A radioactive gas such as Kr85, for example, is added to the burner fill gas. The ionization of the fill gas effected by the radioactivity reduces the breakdown voltage, thus ensuring the ability to be started. However, the use of radioactivity is subject to increasing restriction by legislation.

b) A so-called UV enhancer is installed in the outer bulb. Said enhancer includes a miniaturized discharge tube that emits UV radiation upon the application of the starting voltage. This UV radiation likewise ionizes the burner fill gas, thus ensuring the ability to be started.

c) From the bracket wire, a wire is wound around the capillary with the oppositely poled electrode. Consequently, upon application of the starting voltage, a dielectrically impeded discharge is produced in the region of this electrode, which ionizes the burner fill gas and reduces the starting voltage.

d) The electric potential of one electrode is brought into the vicinity of the counter electrode with the aid of electrically conducting components outside the discharge vessel. As a rule, to this end a wire, clip or similar is wound around the fused seal, pinch or the capillary in the vicinity of the electrode and connected in an electrically conducting fashion to the supply lead of the counter electrode. Consequently, upon application of the starting voltage, a dielectrically impeded discharge is produced in the region of the modified electrode, which ionizes the burner fill gas and reduces the starting voltage.

e) For specific applications, a starting device is used that has a much higher starting pulse, one example being an auto-lamp, in comparison with normal lighting.

The arrangement in accordance with various embodiments adopts the principle of dielectrically impeded discharge, but simplifies it decisively.

The two electrodes are coupled to one another capacitively outside the discharge vessel. To this end, electrically conducting components are fitted behind the one and the other electrode positively and/or nonpositively outside on the discharge vessel and/or fused seal, pinch or capillary, and interconnected in an electrically conducting fashion from one side of the electrode to the other. It is essential that a direct electric contact be produced with neither of the two electrodes or supply leads.

It may be advantageous when the components cover a large surface in the region behind the electrodes and bear as closely as possible against the discharge vessel, capillary or fused seal. The connection of one end of the discharge vessel to the other may be produced with as narrow a component as possible, for example a thin wire, in order to avoid shading the optical radiation.

Technical embodiments are, for example, a wire made from nickel, niobium, molybdenum, tungsten or a similar heat-resistant, electrically conductive material that is wound around the discharge vessel behind one electrode. The wire is tensed via the discharge vessel to the other electrode, where it is likewise wound around the discharge vessel or capillary and/or fused seal behind the electrode. The windings can be embodied symmetrically or asymmetrically. An asymmetric winding may be preferred.

Instead of a wire winding, it is possible in each case to lay a sleeve made from foil or sheet metal around the two ends of the discharge vessel or the capillary, and to weld them. The foils at the two ends are connected by means of a wire or a thin foil strip. A foil may be provided in accordance with various embodiments, e.g. a molybdenum foil, such as is used for the fused seal, since it has a high flexibility and is thermally stable.

In a third variant, instead of a sleeve use is made of a clip which is pushed over the fused seal and/or capillary. The clip can be designed as a spring element such that a nonpositive connection is possible. It may be provided to form on the capillary or fused seal a groove, flat or other specific holding aid into which the clip fits positively.

According to various embodiments, there is no further need for radioactive additions.

Starting of aged lamps is just as ensured as starting of lamps which have just switched off (hot restarting). When use is being made of a starting aid that is connected in an electrically conducting fashion to one of the two electrodes or supply leads, the result may be discharge between the electrode and starting aid lasting several minutes upon hot restarting. The discharge vessel is virtually short-circuited in this case. This effect may be avoided by a starting aid with which no contact is made, since the dielectrically impeded discharge occurs at both electrodes, and thus consequently leads to a disruptive discharge between the electrodes.

Various embodiments may be advantageous in one or, yet more plainly, in a combination of the following lamp types:

a) lamps without metallic parts in the outer bulb;

b) lamps with a discharge vessel made from silica glass and having a sodium-containing fill.

In case b), sodium can escape from the discharge vessel when current-carrying parts pass the discharge vessel on the outside. Since the starting aid in accordance with various embodiments is isolated from the two electrodes, no electric charge can flow off from the components of the starting aid. Consequently, the mechanism that leads to the escape of sodium from the burner is effectively suppressed. By contrast, a starting aid with which direct contact is made leads in the course of the lamp burning life to a more or less substantial escape of sodium, as has already been observed frequently.

In the case of burners made from silica glass, the design of the starting aid as a clip or foil behind the electrode additionally offers the possibility of dispensing with the reflector normally to be found. To this end, the starting aid covers the surface behind the electrodes that is otherwise covered by the reflector. The metallic surface of the starting aid reflects the radiation in the region behind the electrode and ensures that this region is additionally heated. It may be provided to this end for the surface of the starting aid that is directed toward the discharge vessel to have a matt finish (for example sand blasted or ground).

FIG. 1 is a schematic of the basic design of a high pressure discharge lamp 1 with a starting aid. It has a discharge vessel 2 made from ceramic, possibly also made from silica glass, that is accommodated in an outer bulb 3. The outer leads 4 of the discharge vessel, which make contact with the electrodes in the interior, are connected to two frame wires 5 and 6. A short frame wire 5 leads to a first foil 7 in a pinch 8 of the outer bulb. A long frame wire 6, often termed bracket wire, leads to a second foil 7 in the pinch 8. The discharge vessel 2 has a capillary 10 at each of its ends, as known per se, and a fill made from an ionizable gas, as a rule argon or xenon, mercury and metal halides, as likewise known per se. Two electrodes oppose one another in the interior of the discharge vessel, as likewise known per se and not illustrated here.

A starting aid 11 in the form of a foil is respectively laid around the two capillaries of the discharge vessel as a sleeve, and interconnected via an starting strip 15 that can be a coating or else a material sintered on, as is known per se.

Figure 2:
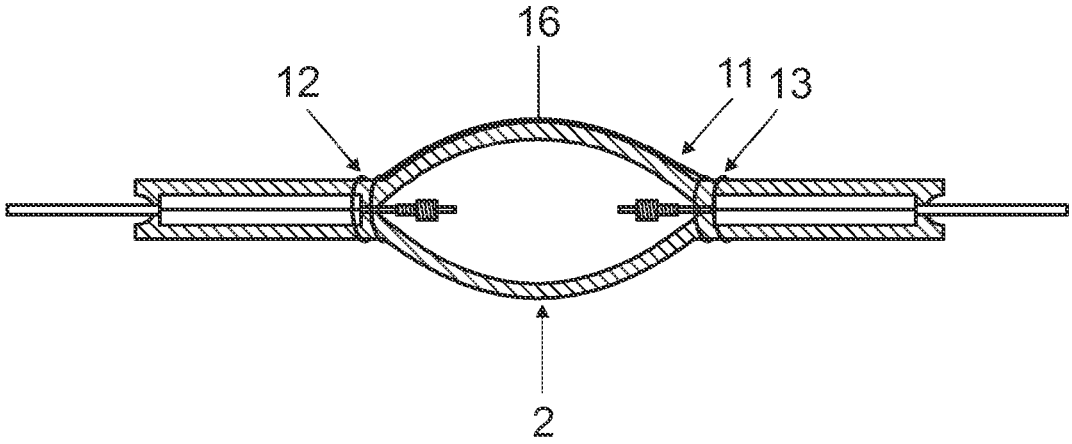
FIG. 2 shows a high pressure discharge lamp with a starting aid, in accordance with a second embodiment.

FIG. 2 shows, as starting aid 11, a symmetrical wire winding with 2-3 turns per end. The two winding parts 12 and 13 on the two pinches or fused seals of the discharge vessel 2 made from silica glass are interconnected via a wire 16 or other conductor that extends over the bellied middle part of the discharge vessel.

Figure 3:
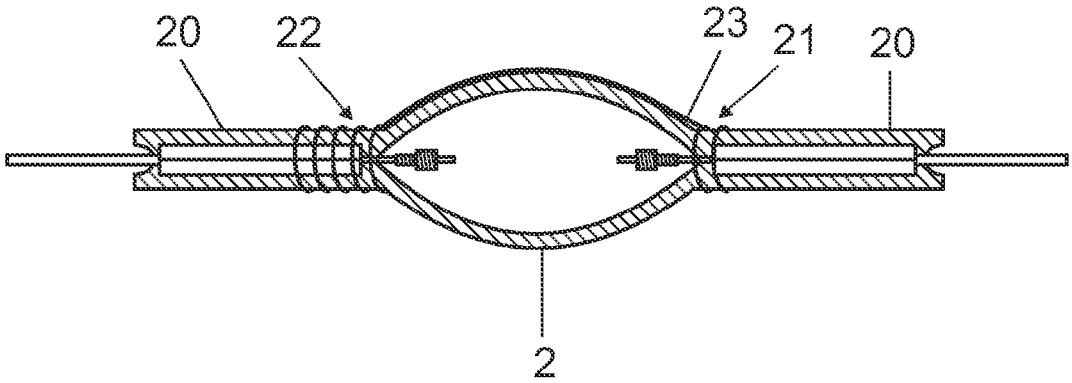
FIG. 3 shows a high pressure discharge lamp with a starting aid, in accordance with a third embodiment.

FIG. 3 shows a similar system, in which the wire windings are asymmetrically fashioned. Here, approximately two to three turns 21 are situated on one pinch 20, and approximately eight to ten turns 22 are situated on the second pinch 20. These two winding parts 21 and 22 are again connected via a starting strip or wire 23. The ratio of the number of turns per unit length of the winding should preferably be 2:1 to 4:1.

Figure 4:
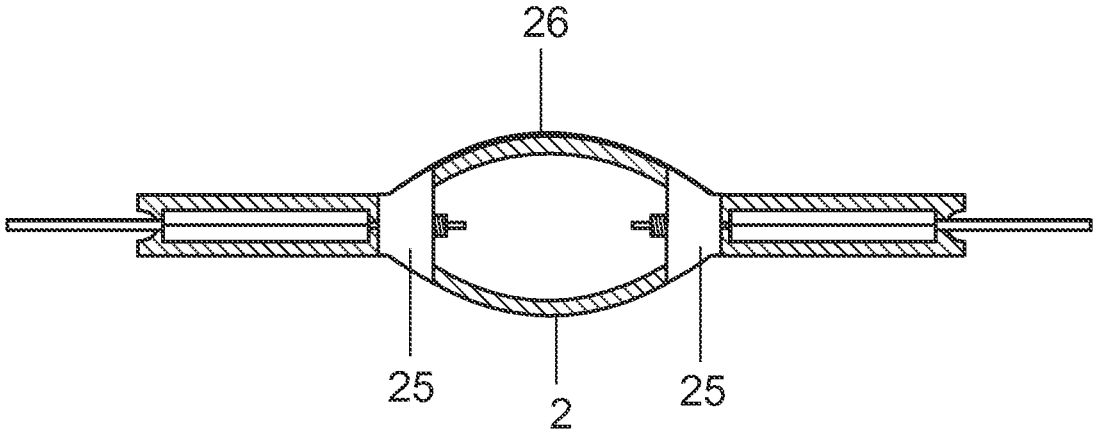
FIG. 4 shows a high pressure discharge lamp with a starting aid, in accordance with a fourth embodiment.

FIG. 4 shows a discharge vessel 2 made from silica glass, in the case of which at the ends of the bellied discharge vessel foil strips 25 are wound as collars around the ends of the discharge vessel and connected by a wire 26. This embodiment is expedient precisely whenever the aim with discharge vessels made from silica glass is in any case to make use of a reflector at the ends. This is due to the fact that the foils additionally have reflective properties.

Figure 5:
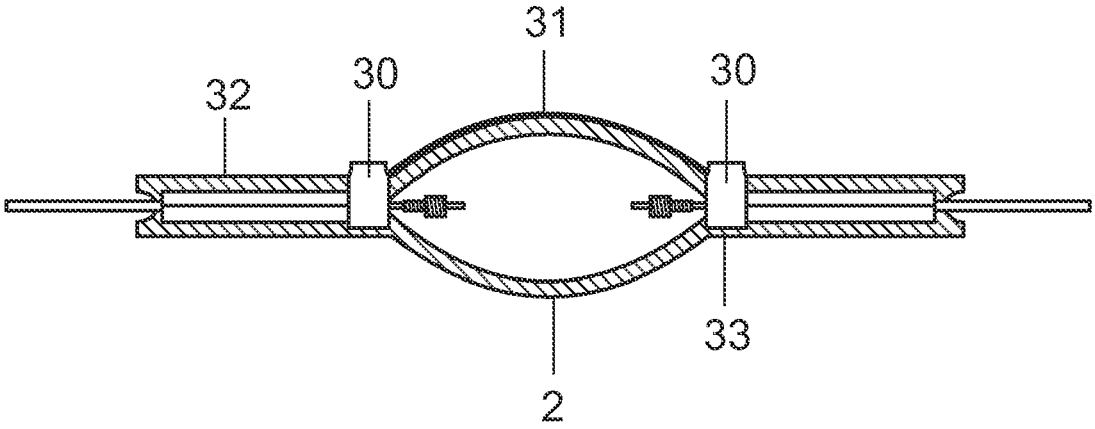
FIG. 5 shows a high pressure discharge lamp with a starting aid, in accordance with a fifth embodiment.
Figure 6:
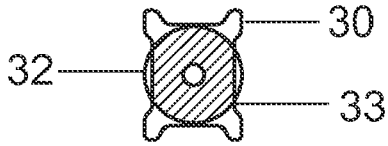
FIG. 6 shows a detail from FIG. 5.

FIG. 5 shows a discharge vessel 2 made from silica glass, wherein the starting aid is respectively a clip 30 on the two seals, fused seals or pinches that is pushed laterally over the fused seal 32 shown here. FIG. 6 shows a cross section at the site of the clip 30. The two clips are connected to a wire 31. This embodiment is equally well suited to discharge vessels made from silica glass or ceramic. The cross section of FIG.

6 shows a fused seal (round cross section) with a flat 33 such that a particularly good seating of the clip 30 is enabled. In principle, the fused seal can, however, also manage without the flat, and the clip is a partial circle bent in the form of a C and made from spring sheet metal. In principle, it is possible to implement an asymmetric embodiment by selecting the width of the clips or of a foil differently on the two seals. Alternatively or in addition, the length of the clips or foils can also be selected to be different. The dimensioning rule is explained by analogy with FIG. 3.

Figure 7:
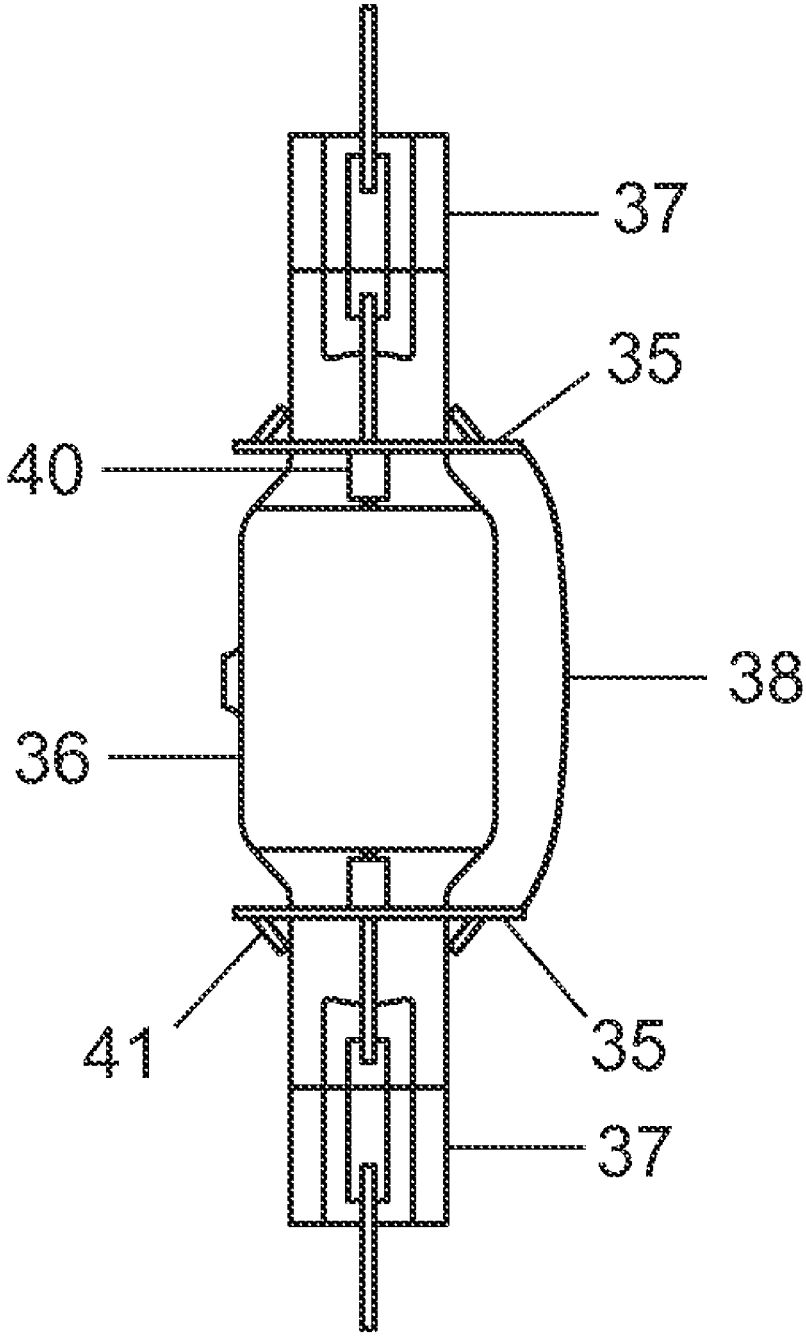
FIG. 7 shows a high pressure discharge lamp with a starting aid, in accordance with a sixth embodiment.
Figure 8:
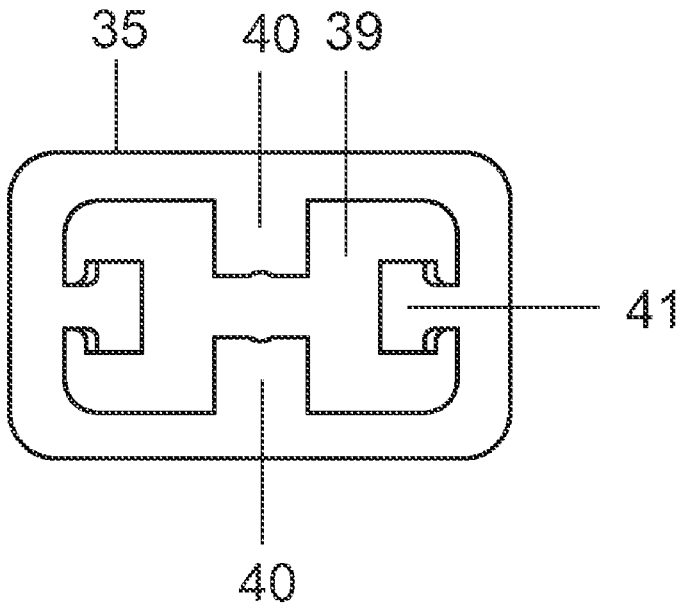
FIG. 8 shows a detail from FIG. 7.
Figure 9:
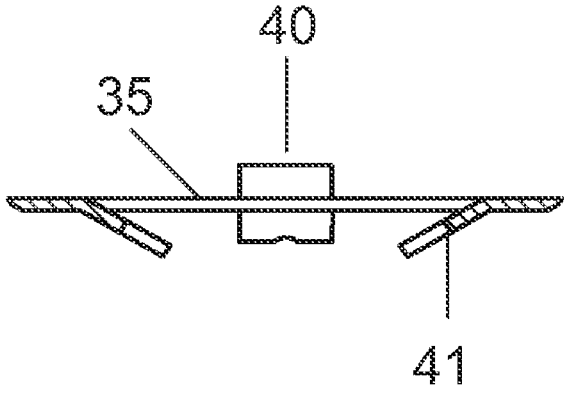
FIG. 9 shows the detail from FIG. 7, rotated by 90.

FIGS. 7 to 9 show a clip variant for a discharge vessel 36 made from silica glass with a pinch 37. Said variant involves two clips 35 made from spring sheet metal, which are pushed onto the pinches 37 and are interconnected via a wire 38. The clip 35 made from spring sheet metal has a central hole 39 whose contour is adapted to the double T-shape of the pinch. Two tongues 40 are supported in each case in the middle at the wide ends of the seal, and act in a fixing fashion in cooperation with two lugs 41, functioning as barbs, at the narrow sides of the pinch.

Figure 10:
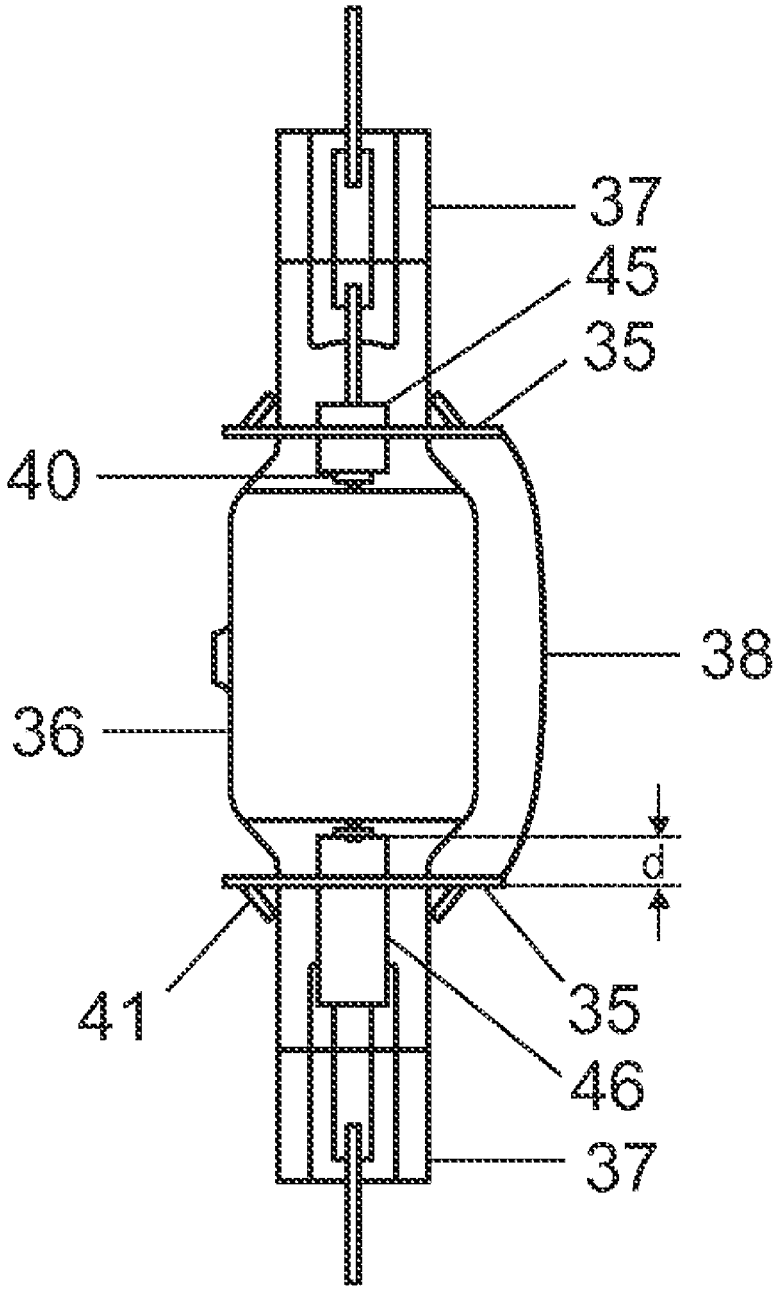
FIG. 10 shows a further embodiment of a high pressure discharge lamp.
Figure 11:
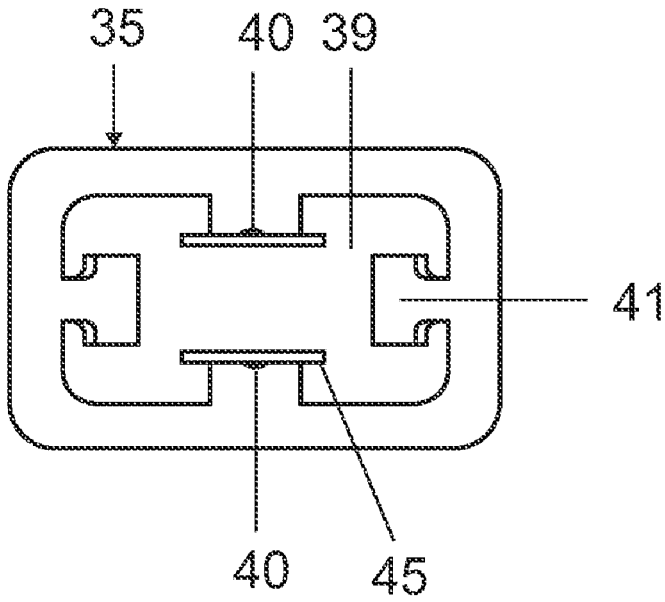
FIGS. 11 and 12 show details from FIG. 10.
Figure 12:
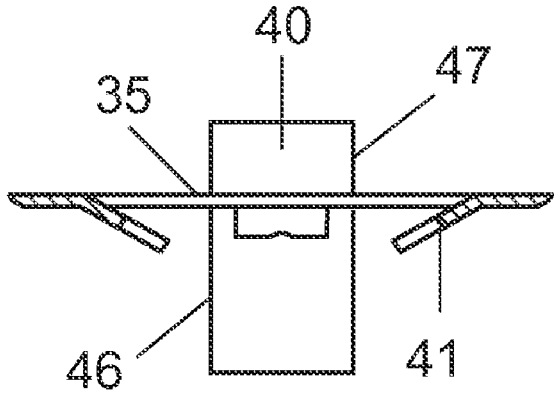

FIG. 10 and the detail from FIG. 11 and FIG. 12 show a high pressure discharge lamp having a discharge vessel made from silica glass that is closed at two ends with the aid of a pinch. Here, as well, two clips 35 are pushed onto the pinches and interconnected via a wire 38. A pronounced asymmetry of the induced electric field strength is achieved here by virtue of the fact that an approximately rectangular platelet 45, 46 made from thin sheet metal is placed on the two wide ends of each pinch. The platelet 45, 46 is respectively clamped by the clip 35 in the direction of the pinch, or it can also be produced in one piece with the clip. Here, the platelet 45 has as small a surface as possible at a first end. In this case, the width of the platelet 45 is approximately adapted to the width of the pinch 37. The axial length of the platelet 45 is relatively short, but it may be at least 2 mm in accordance with various embodiments. The surface of the platelets 46 on the second pinch 37 should be selected to be much larger, specifically preferably at least three times as large. The platelet may, by way of example, reach up to the end of the pinch.

In various embodiments, it may be 4 to 6 times as large as at the first end. A suitably high field strength is induced in this way upon starting by the smaller platelet when the lamp is started. In various embodiments, each platelet 45, 46 may reach as close as possible to the discharge volume of the discharge vessel. This is ensured by virtue of the fact that a small part 47 of the platelet reaches at least up to the exit point of the electrode shaft from the pinch. The platelet 45, 46 can even be angled outwards at its short end in the region of the small part 47 such that it is guided along the discharge volume over a certain distance d.

At the second end with the second pinch 37, the platelet 46 anchored there is approximately four times as long axially as on the first pinch. In accordance with FIG. 11, the platelet is pressed against the pinch by a lug at the wide end of the clip. The platelet 45, 46 can be fabricated from stainless steel, Mo, or Ni, or else from another sheet metal that can effectively withstand temperatures up to approximately 600° C.

Figure 13:
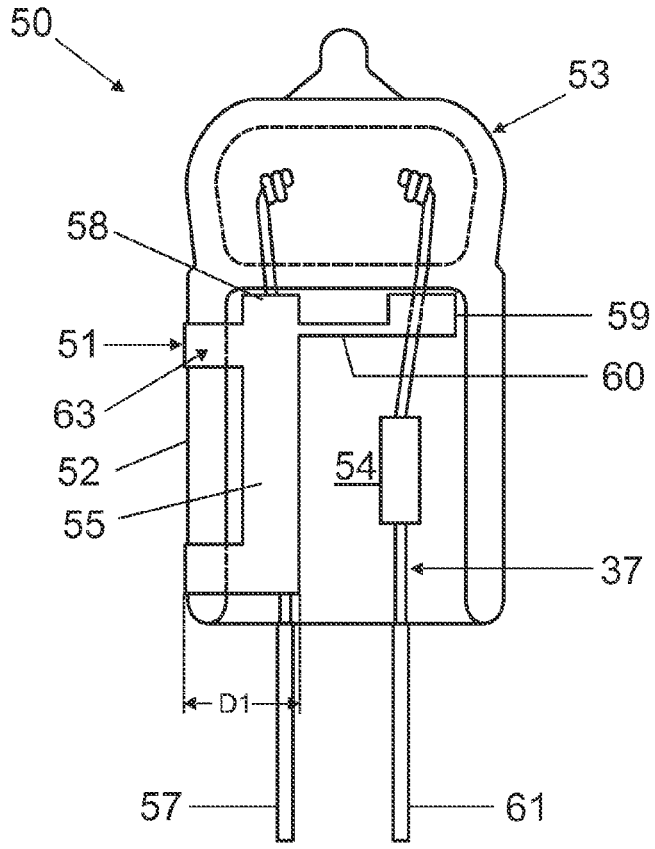
FIG. 13 shows a further embodiment of a high pressure discharge lamp.
Figure 14:
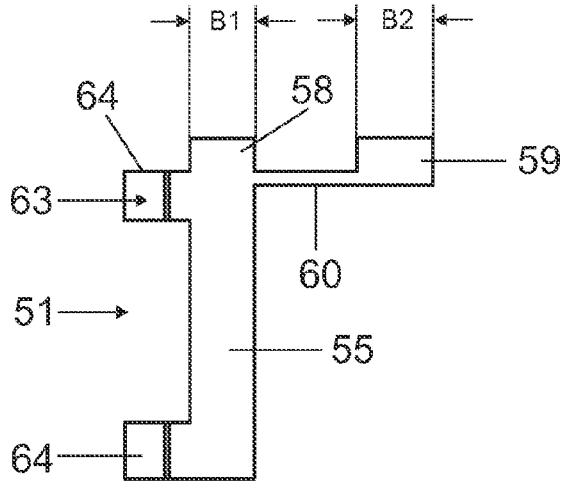
FIG. 14 a detail from FIG. 13.

FIG. 13 shows an embodiment for a high pressure discharge lamp 50 that is pinched at one end. Use may be made for this purpose of a clip 51 that is crimped on at a narrow end 52 of the sole pinch 37 of the discharge vessel 53. The pinch 37 may be fashioned in the shape of an I or a double T for this purpose. Starting from the narrow end 52, a base body 63 of the clip 51 extends a short distance (D1) to the wide end 54. A sheet metal strip 55 of the clip, which is parallel to the axis, preferably covers the region of the first supply lead 57 or foil adjacent to the clip, a first tongue 58 with a width B1 extending up to the edge of the discharge volume. A thin web 60 is arranged transverse to the strip and ends at a second tongue 59, which is seated in the region of the entry of the second electrode system 61 into the discharge volume. This second tongue 59 is mostly of the same width as, or even a smaller width than, the first tongue, or else has a greater width B2 than the first tongue, as illustrated here. What is essential is that here, as well, an asymmetry is produced in the electric field respectively induced up to the assigned electrode. This is governed in the case of the first electrode by the surface of the sheet metal strip 55 plus first tongue 58, which act together as a first functional part, and in the case of the second electrode, the second tongue 59 alone, which acts as second functional part. Specifically, the base body of the clip is preferably implemented by only two yokes 64 that interconnect the sheet metal strips 55 at the two ends of the pinch 37. The base body can, however, also be fashioned differently.

Various features of various embodiments are as follows in the form of an enumeration:

1. A high pressure discharge lamp with a capacitive starting aid, having a discharge vessel that is accommodated in an outer bulb, the discharge vessel having at least one end with a seal in which an electrode system is fastened, a frame holding the discharge vessel in the outer bulb, wherein a starting aid which has two functional parts is fastened on the seal.

2. The high pressure discharge lamp in accordance with various embodiments, wherein the discharge vessel has two ends, one of the two starting aid parts being seated on a seal in each case, and the two starting aid parts being interconnected via an electric line, e.g. a wire.

3. The high pressure discharge lamp in accordance with various embodiments, wherein the starting aid is a symmetrical winding on both seals, e.g. one to four windings.

4. The high pressure discharge lamp in accordance with various embodiments, wherein the starting aid is an asymmetric winding on both seals, e.g. split in a ratio of 2:1 to 4:1 as number of turns per unit length.

5. The high pressure discharge lamp in accordance with various embodiments, wherein the starting aid is in each case a foil strip on the ends of the discharge vessel.

6. The high pressure discharge lamp in accordance with various embodiments, wherein the starting aid is a clip on the seals, e.g. symmetrically fashioned or asymmetrically fashioned, e.g. with a different width of the clip.

7. The high pressure discharge lamp in accordance with various embodiments, wherein the starting aid is a spring sheet-metal part.

8. The high pressure discharge lamp in accordance with various embodiments, wherein the discharge vessel is sealed at one end, the seal being a pinch, and the starting aid having two tongues that are interconnected via a web, e.g. the two tongues being arranged in the region of the pinch and, e.g., the functional parts having asymmetric surfaces, specifically a first functional part having a first tongue plus a base part, and a second functional part having only a second tongue.

9. The high pressure discharge lamp in accordance with various embodiments, wherein the discharge vessel is made from silica glass and has a metal halide fill that is substantially free of Na.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A high pressure discharge lamp with a capacitive starting aid, the high pressure discharge lamp comprising:

a discharge vessel that is accommodated in an outer bulb, wherein the discharge vessel has two ends provided with seals, in which electrodes are fastened;

a frame holding the discharge vessel in the outer bulb;

a starting aid fastened on the seals;

wherein the starting aid comprises two clips, respectively attached at each of said seals and an electric line connected between the clips.

2. The high pressure discharge lamp as claimed in claim 1, wherein the electric line comprises a wire.

3. The high pressure discharge lamp as claimed in claim 2, wherein the clips on the seals are symmetrically fashioned or asymmetrically fashioned.

4. The high pressure discharge lamp as claimed in claim 3, wherein the clips on the seals are symmetrically fashioned or asymmetrically fashioned with a different width of the clip.

5. The high pressure discharge lamp as claimed in claim 2, wherein the clip is a spring sheet-metal part.

6. The high pressure discharge lamp as claimed in claim 2, wherein the discharge vessel is made from silica glass and has a metal halide fill that is substantially free of Na.

7. The high pressure discharge lamp as claimed in claim 2, wherein the seals are fused seals, which are provided with a flat for the seating of the clip.

* * * * *